US007467955B2

(12) United States Patent
Raistrick et al.

(10) Patent No.: US 7,467,955 B2
(45) Date of Patent: Dec. 23, 2008

(54) IMPEDANCE CONTROL IN ELECTRICAL CONNECTORS

(75) Inventors: Alan Raistrick, Rockville, MD (US); Joseph B. Shuev, Camp Hill, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 11/595,338

(22) Filed: Nov. 10, 2006

(65) Prior Publication Data

US 2007/0059952 A1 Mar. 15, 2007

Related U.S. Application Data

(63) Continuation of application No. 11/235,036, filed on Sep. 26, 2005, which is a continuation of application No. 10/918,565, filed on Aug. 13, 2004, now Pat. No. 6,981,883, which is a continuation-in-part of application No. 10/294,966, filed on Nov. 14, 2002, now Pat. No. 6,976,886, which is a continuation-in-part of application No. 10/155,786, filed on May 24, 2002, now Pat. No. 6,652,318, and a continuation-in-part of application No. 09/990,794, filed on Nov. 14, 2001, now Pat. No. 6,692,272.

(51) Int. Cl.
*H01R 12/00* (2006.01)

(52) U.S. Cl. ..... 439/75

(58) Field of Classification Search ..... 439/79, 439/941, 74, 75, 608, 715, 701
See application file for complete search history.

(56) References Cited

U.S. PATENT DOCUMENTS

| | | | | |
|---|---|---|---|---|
| 3,286,220 | A | 11/1966 | Marley et al. | 439/680 |
| 3,538,486 | A | 11/1970 | Shlesinger, Jr. | 439/268 |
| 3,669,054 | A | 6/1972 | Desso et al. | 113/119 |
| 3,748,633 | A | 7/1973 | Lundergan | 339/217 S |
| 4,076,362 | A | 2/1978 | Ichimura | 339/75 |
| 4,159,861 | A | 7/1979 | Anhalt | 339/75 |

(Continued)

FOREIGN PATENT DOCUMENTS

EP 0 273 683 A2 7/1988

(Continued)

OTHER PUBLICATIONS

Nadolny, J. et al., "Optimizing Connector Selection for Gigabit Signal Speeds", *ECN*™, Sep. 1, 2000, http://www.ecnmag.com/article/CA45245, 6 pages.

(Continued)

*Primary Examiner*—Ross N Gushi
(74) *Attorney, Agent, or Firm*—Woodcock Washburn LLP

(57) ABSTRACT

The invention provides a high speed connector wherein differential signal pairs are arranged so as to limit the level of cross talk between adjacent differential signal pairs. The connector comprises lead frame assembly having a pair of overmolded lead frame housings. Each lead frame housing has a respective signal contact extending therethrough. The lead frame housings may be operatively coupled such that the signal contacts form a broadside-coupled differential signal pair. The contacts may be separated by a gap having a gap width that enables insertion loss and cross talk between signal pairs to be limited.

47 Claims, 13 Drawing Sheets

U.S. PATENT DOCUMENTS 4,260,212 A 4/1981 Ritchie et al. ..... 339/97 R
4,288,139 A 9/1981 Cobaugh et al. ..... 339/74 R
4,383,724 A 5/1983 Verhoeven ..... 439/510
4,402,563 A 9/1983 Sinclair ..... 339/75
4,560,222 A 12/1985 Dambach ..... 339/75
4,717,360 A 1/1988 Czaja ..... 439/710
4,776,803 A 10/1988 Pretchel et al. ..... 439/59
4,815,987 A 3/1989 Kawano et al. ..... 439/263
4,867,713 A 9/1989 Ozu et al. ..... 439/833
4,907,990 A 3/1990 Bertho et al. ..... 439/851
4,913,664 A 4/1990 Dixon et al. ..... 439/607
4,973,271 A 11/1990 Ishizuka et al. ..... 439/839
5,066,236 A 11/1991 Broeksteeg ..... 439/79
5,077,893 A 1/1992 Mosquera et al. ..... 29/882
5,163,849 A 11/1992 Fogg et al. ..... 439/497
5,167,528 A 12/1992 Nishiyama et al. ..... 439/489
5,174,770 A 12/1992 Sasaki et al. ..... 439/108
5,238,414 A 8/1993 Yaegashi et al. ..... 439/108
5,254,012 A 10/1993 Wang ..... 439/263
5,274,918 A 1/1994 Reed ..... 29/882
5,277,624 A 1/1994 Champion et al. ..... 439/607
5,286,212 A 2/1994 Broeksteeg ..... 439/108
5,302,135 A 4/1994 Lee ..... 439/263
5,342,211 A 8/1994 Broeksteeg ..... 439/108
5,356,300 A 10/1994 Costello et al. ..... 439/101
5,356,301 A 10/1994 Champion et al. ..... 439/108
5,357,050 A 10/1994 Baran et al. ..... 174/33
5,431,578 A 7/1995 Wayne ..... 439/259
5,475,922 A 12/1995 Tamura et al. ..... 29/881
5,558,542 A 9/1996 O'Sullivan et al. ..... 439/682
5,586,914 A 12/1996 Foster, Jr. et al. ..... 439/676
5,590,463 A 1/1997 Feldman et al. ..... 29/844
5,609,502 A 3/1997 Thumma ..... 439/747
5,713,746 A 2/1998 Olson et al. ..... 439/79
5,730,609 A 3/1998 Harwath ..... 439/108
5,741,144 A 4/1998 Elco et al. ..... 439/101
5,741,161 A 4/1998 Cahaly et al. ..... 439/709
5,795,191 A 8/1998 Preputnick et al. ..... 439/608
5,817,973 A 10/1998 Elco et al. ..... 174/32
5,853,797 A 12/1998 Fuchs et al. ..... 427/96
5,908,333 A 6/1999 Perino et al. ..... 439/631
5,961,355 A 10/1999 Morlion et al. ..... 439/686
5,967,844 A 10/1999 Doutrich et al. ..... 439/607
5,971,817 A 10/1999 Longueville ..... 439/857
5,980,321 A 11/1999 Cohen et al. ..... 439/608
5,993,259 A 11/1999 Stokoe et al. ..... 439/608
6,050,862 A 4/2000 Ishii ..... 439/843
6,068,520 A 5/2000 Winings et al. ..... 439/676
6,116,926 A 9/2000 Ortega et al. ..... 439/108
6,116,965 A 9/2000 Arnett et al. ..... 439/692
6,123,554 A 9/2000 Ortega et al. ..... 439/79
6,125,535 A 10/2000 Chiou et al. ..... 29/883
6,129,592 A 10/2000 Mickievicz et al. ..... 439/701
6,139,336 A 10/2000 Olson ..... 439/83
6,146,157 A 11/2000 Lenoir et al. ..... 439/101
6,146,203 A 11/2000 Elco et al. ..... 439/609
6,171,115 B1 1/2001 Mickievicz et al. ..... 439/76.1
6,171,149 B1 1/2001 Van Zanten ..... 439/608
6,190,213 B1 2/2001 Reichart et al. ..... 439/736
6,212,755 B1 4/2001 Shimada et al. ..... 29/527.1
6,219,913 B1 4/2001 Uchiyama ..... 29/883
6,220,896 B1 4/2001 Bertoncici et al. ..... 439/608
6,227,882 B1 5/2001 Ortega et al. ..... 439/101
6,267,604 B1 7/2001 Mickievicz et al. ..... 439/79
6,269,539 B1 8/2001 Takahashi et al. ..... 29/883
6,280,209 B1 8/2001 Bassler et al. ..... 439/101
6,293,827 B1 9/2001 Stokoe et al. ..... 439/608
6,319,075 B1 11/2001 Clark et al. ..... 439/825
6,322,379 B1 11/2001 Ortega et al. ..... 439/108
6,322,393 B1 11/2001 Doutrich et al. ..... 439/607
6,328,602 B1 12/2001 Yamasaki et al. ..... 439/608
6,343,955 B2 2/2002 Billman et al. ..... 439/608
6,347,952 B1 2/2002 Hasegawa et al. ..... 439/608
6,350,134 B1 2/2002 Fogg et al. ..... 439/79
6,354,877 B1 3/2002 Shuey et al. ..... 439/608
6,358,061 B1 3/2002 Regnier ..... 439/60
6,361,366 B1 3/2002 Shuey et al. ..... 439/608
6,363,607 B1 4/2002 Chen et al. ..... 29/883
6,364,710 B1 4/2002 Billman et al. ..... 439/608
6,371,773 B1 4/2002 Crofoot et al. ..... 439/79
6,375,478 B1 4/2002 Kikuchi ..... 439/79
6,379,188 B1 * 4/2002 Cohen et al. ..... 439/608
6,386,914 B1 5/2002 Collins et al. ..... 439/579
6,409,543 B1 6/2002 Astbury, Jr. et al. ..... 439/608
6,431,914 B1 8/2002 Billman ..... 439/608
6,435,914 B1 8/2002 Billman ..... 439/608
6,461,202 B2 10/2002 Kline ..... 439/701
6,471,548 B2 10/2002 Bertoncini et al. ..... 439/608
6,482,038 B2 11/2002 Olson ..... 439/608
6,485,330 B1 11/2002 Doutrich ..... 439/572
6,494,734 B1 12/2002 Shuey ..... 439/378
6,506,081 B2 1/2003 Blanchfield et al. ..... 439/682
6,520,803 B1 2/2003 Dunn ..... 439/608
6,527,587 B1 3/2003 Ortega et al. ..... 439/608
6,537,111 B2 3/2003 Brammer et al. ..... 439/857
6,540,559 B1 4/2003 Kemmick et al. ..... 439/608
6,547,066 B2 4/2003 Koch ..... 206/308.1
6,554,647 B1 4/2003 Cohen et al. ..... 439/607
6,572,410 B1 6/2003 Volstorf et al. ..... 439/608
6,652,318 B1 11/2003 Winings et al. ..... 439/608
6,692,272 B2 2/2004 Lemke et al. ..... 439/108
6,695,627 B2 2/2004 Ortega et al. ..... 439/78
6,762,067 B1 7/2004 Quinones et al.
6,764,341 B2 7/2004 Lappoehn ..... 439/608
6,776,649 B2 8/2004 Pape et al. ..... 439/485
6,805,278 B1 10/2004 Olson et al.
6,808,399 B2 10/2004 Rothermel et al. ..... 439/108
6,824,391 B2 11/2004 Mickievicz et al.
6,843,686 B2 1/2005 Ohnishi et al. ..... 439/608
6,848,944 B2 2/2005 Evans ..... 439/608
6,851,974 B2 2/2005 Doutrich ..... 439/572
6,852,567 B1 2/2005 Lee et al.
6,863,543 B2 * 3/2005 Lang et al. ..... 439/75
6,869,292 B2 3/2005 Johnescu et al. ..... 439/74
6,890,214 B2 5/2005 Brown et al. ..... 439/608
6,913,490 B2 7/2005 Whiteman, Jr. et al. ..... 439/608
6,932,649 B1 8/2005 Rothermel et al. ..... 439/620
6,945,796 B2 9/2005 Bassler et al. ..... 439/101
6,953,351 B2 10/2005 Fromm et al. ..... 439/101
6,969,280 B2 11/2005 Chien et al. ..... 439/608
6,981,883 B2 1/2006 Raistrick et al. ..... 439/74
6,994,569 B2 2/2006 Minich et al.
7,097,506 B2 8/2006 Nakada ..... 439/608
7,118,391 B2 10/2006 Minich et al.
7,131,870 B2 11/2006 Whiteman, Jr. et al.
2002/0098727 A1 7/2002 McNamara et al.
2002/0106930 A1 8/2002 Pape et al. ..... 439/485
2003/0143894 A1 7/2003 Kline et al. ..... 439/608
2003/0171010 A1 9/2003 Winings et al. ..... 439/55
2003/0203665 A1 10/2003 Ohnishi et al. ..... 439/79
2003/0220021 A1 11/2003 Whiteman, Jr. et al. ..... 439/608
2005/0009402 A1 1/2005 Chien et al. ..... 439/608
2005/0118869 A1 6/2005 Evans ..... 439/608
2006/0014433 A1 1/2006 Consoli et al. ..... 439/608
2006/0046526 A1 3/2006 Minich et al.
2006/0192274 A1 8/2006 Lee J et al.

FOREIGN PATENT DOCUMENTS

EP 0 891 016 10/2002
EP 1 148 587 B1 4/2005
JP 06-236788 8/1994
JP 07-114958 5/1995
JP 11-185 886 7/1999

| | | | |
|---|---|---|---|
| JP | 2000-003743 | | 1/2000 |
| JP | 2000-003744 | | 1/2000 |
| JP | 2000-003745 | | 1/2000 |
| JP | 2000-003746 | | 1/2000 |
| WO | WO 90/16093 | | 12/1990 |
| WO | WO 01/29931 | A1 | 4/2001 |
| WO | WO 01/39332 | A1 | 5/2001 |
| WO | WO 02/101882 | | 12/2002 |
| WO | WO 2006/031296 | A2 | 3/2006 |

OTHER PUBLICATIONS

"PCB-Mounted Receptacle Assemblies, 2.00 mm(0.079in) Centerlines, Right-Angle Solder-to-Board Signal Receptacle", *Metral*™, Berg Electronics, 10-6-10-7, 2 pages.

*Metral*™, "Speed & Density Extensions", *FCI*, Jun. 3, 1999, 25 pages.

Framatome Connector Specification, 1 page.

MILLIPACS Connector Type A Specification, 1 page.

Fusi, M.A. et al., "Differential Signal Transmission through Backplanes and Connectors", *Electronic Packaging and Production*, Mar. 1996, 27-31.

Goel, R.P. et al., "AMP Z-Pack Interconnect System", 1990, AMP Incorporated, 9 pages.

"FCI's Airmax VS® Connector System Honored at DesignCon", 2005, Heilind Electronics, Inc., http://www.heilind.com/products/fci/airmax-vs-design.asp, 1 page.

Hult, B., "FCI's Problem Solving Approach Changes Market, The FCI Electronics AirMax VS®", *ConnectorSupplier.com*, Http://www.connectorsupplier.com/tech_updates_FCI-Airmax_archive.htm, 2006, 4 pages.

Backplane Products Overview Page, http://www.molex.com/cgi-bin/bv/molex/super_family/super_family.jsp?BV_Session ID=@, 2005-2006 © Molex, 4 pages.

AMP Z-Pack 2mm HM Interconnection System, 1992 and 1994 © by AMP Incorporated, 6 pages.

Metral® 2mm High-Speed Connectors, 1000, 2000, 3000 Series, Electrical Performance Data for Differential Applications, FCI Framatome Group, 2 pages, HDM® HDM Plus® Connectors, http://www.teradyne.com/prods/tcs/products/connectors/backplane/hdm/index.html, 2006, 1 page.

Amphenol TCS (ATCS): HDM® Stacker Signal Integrity, http://www.teradyne.com/prods/tcs/products/connectors/mezzanine/hdm_stacker/signintegr, 3 pages.

Amphenol TCS (ATCS): VHDM Connector, http://www.teradyne.com/prods/tcs/products/connectors/backplane/vhdm/index.html, 2 pages.

VHDM High-Speed Differential (VHDM HSD), http://www.teradyne.com/prods/bps/vhdm/hsd.html, 6 pages.

Amphenol TCS(ATCS): VHDM L-Series Connector, http://www.teradyne.com/prods/tcs/products/connectors/backplane/vhdm_1-series/index.html, 2006, 4 pages.

VHDM Daughterboard Connectors Feature press-fit Terminations and a Non-Stubbing Seperable Interface, © Teradyne, Inc. Connections Systems Division, Oct. 8, 1997, 46 pages.

HDM/HDM *plus*, 2mm Backplane Interconnection System, Teradyne Connection Systems, © 1993, 22 pages.

HDM Separable Interface Detail, Molex®, 3 pages.

"Lucent Technologies' Bell Labs and FCI Demonstrate 25gb/S Data Transmission over Electrical Backplane Connectors", Feb. 1, 2005, http://www.lucent.com/press/0205/050201.bla.html, 4 pages.

"B.? Bandwidth and Rise Time Budgets", Module 1-8. Fiber Optic Telecommunications (E-XVI-2a), http://cord.org/step_online/st1-8/st18exvi2a.htm, 3 pages.

"Tyco Electronics, Z-Dok and Connector", Tyco Electronics, Jun. 23, 2003, http://2dok.tyco.elcetronics.com, 15 pages.

Tyco Electronics/AMP, "Z-Dok and Z-Dok and Connectors", Application Specification # 114-13068, Aug. 30, 2005, Revision A, 16 pages.

Tyco Electronics, "Champ Z-Dok Connector System", catalog # 1309281, Issued Jan. 2002, 3 pages.

GIG-Array® High Speed Mezzanine Connectors 15-40 mm Board to Board, Jun. 5, 2006, 1 page.

Communications, Data, Consumer Division Mezzanine High-Speed High-Density Connectors GIG-Array® and MEG-Array® electrical Performance Data, 10 pages FCI Corporation.

AMP Z-Pack 2mm HM Connector, 2mm Centerline, Eight-Row, Right-Angle Applications, Electrical Performance Report, EPR 889065, Issued Sep. 1998, 59 pages.

AMP Z-Pack HM-Zd Performance at Gigabit Speeds, Tyco Electronics, Report #20GC014, Rev.B., May 4, 2001, 30 pages.

Honda Connectors, "Honda High-Speed Backplane Connector NSP Series", Honda Tsushin Kogoyo Co., Ltd., Development Engineering Division, Tokyo , Japan, Feb. 7, 2003, 25 pages.

NSP, Honda The World Famous Connectors, http://www.honda-connectors.co.jp, 6 pages, English Language Translation attached.

4.0 UHD Connector: Differential Signal Crosstalk, Reflections, 1998, pp. 8-9.

* cited by examiner

IMPEDANCE CONTROL IN ELECTRICAL CONNECTORS

CROSS REFERENCE TO RELATED APPLICATIONS

This application is a continuation of U.S. application Ser. No. 11/235,036, filed Sep. 26, 2005, which is a continuation of application Ser. No. 10/918,565, filed Aug. 13, 2004, now U.S. Pat. No. 6,981,883 which is a continuation-in-part of U.S. application Ser. No. 10/294,966, filed Nov. 14, 2002, now U.S. Pat. No. 6,976,886 which is a continuation-in-part of U.S. application Ser. No. 09/990,794, filed Nov. 14, 2001, now U.S. Pat. No. 6,692,272, and Ser. No. 10/155,786, filed May 24, 2002, now U.S. Pat. No. 6,652,318. The contents of each of the above-referenced U.S. patents and patent applications are herein incorporated by reference in their entireties.

FIELD OF THE INVENTION

Generally, the invention relates to the field of electrical connectors. More particularly, the invention relates to an impedance-controlled insert molded leadframe assembly ("IMLA") in a "split" configuration.

BACKGROUND OF THE INVENTION

Electrical connectors provide signal connections between electronic devices using signal contacts. Often, the signal contacts are so closely spaced that undesirable interference, or "cross talk," occurs between adjacent signal contacts. As used herein, the term "adjacent" refers to contacts (or rows or columns) that are next to one another. Cross talk occurs when one signal contact induces electrical interference in an adjacent signal contact due to intermingling electrical fields, thereby compromising signal integrity. With electronic device miniaturization and high speed, high signal integrity electronic communications becoming more prevalent, the reduction of cross talk becomes a significant factor in connector design.

One commonly used technique for reducing cross talk is to position separate electrical shields, in the form of metallic plates, for example, between adjacent signal contacts. Another commonly used technique to block cross talk between signal contacts is to place ground contacts amongst the signal contacts of a connector. The shields and ground contacts act to block cross talk between the signal contacts by blocking the intermingling of the contacts' electric fields. FIGS. 1A and 1B depict exemplary contact arrangements for electrical connectors that use shields to block cross talk.

FIG. 1A depicts an arrangement in which signal contacts S and ground contacts G are arranged such that differential signal pairs S+, S− are positioned along columns 101-106. As can be seen in FIG. 1A, the signal pairs are edge coupled (i.e., where the edge of one contact is adjacent to the edge of an adjacent contact). Shields 112 can be positioned between contact columns 101-106. A column 101-106 can include any combination of signal contacts S+, S− and ground contacts G. The ground contacts G serve to block cross talk between differential signal pairs in the same column. The shields 112 serve to block cross talk between differential signal pairs in adjacent columns.

FIG. 1B depicts an arrangement in which signal contacts S and ground contacts G are arranged such that differential signal pairs S+, S− are positioned along rows 111-116. As can be seen in FIG. 1B, the signal pairs are broadsidecoupled (i.e., where the broad side of one contact is adjacent to the broad side of an adjacent contact). Shields 122 can be positioned between rows 111-116. A row 111-116 can include any combination of signal contacts S+, S− and ground contacts G. The ground contacts G serve to block cross talk between differential signal pairs in the same row. The shields 122 serve to block cross talk between differential signal pairs in adjacent rows.

Because of the demand for smaller, lower weight communications equipment, it is desirable that connectors be made smaller and lower in weight, while providing the same performance characteristics. Shields and ground contacts take up valuable space within the connector that could otherwise be used to provide additional signal contacts, and thus limit contact density (and, therefore, connector size). Additionally, manufacturing and inserting such shields and ground contacts substantially increase the overall costs associated with manufacturing such connectors. For example, in some applications, shields are known to make up 40% or more of the cost of the connector. Another known disadvantage of shields is that they lower impedance. Thus, to make the impedance high enough in a high contact density connector, the contacts would need to be so small that they would not be robust enough for many applications. Furthermore, ground contacts can take up a large percentage of the available contacts in a connector, thus causing an increase in size and weight of the connector for a given number of differential signal pairs.

Therefore, a need exists for a lightweight, high-speed electrical connector that reduces the occurrence of cross talk without the need for separate shields or ground contacts, and provides for a variety of other benefits not found in prior art connectors. More particularly, what is needed is an impedance-controlled insert molded leadframe assembly (IMLA) that maintains a distance between broadside coupled signal pairs such that cross-talk between signal pairs may be limited without the use of shields or ground contacts.

SUMMARY OF THE INVENTION

The invention provides a high speed connector wherein differential signal pairs are arranged so as to limit the level of cross talk between adjacent differential signal pairs. The connector comprises a plurality of signal contact pairs, where the contacts of each pair are separated by a gap. The gap is formed over a distance such that insertion loss and cross talk between the plurality of signal contact pairs are limited. Thus, shields and/or ground contacts are not needed in an embodiment.

In one embodiment, the connector may be comprised of a header leadframe assembly and a receptacle leadframe assembly. Each leadframe assembly may include an overmolded housing and a set of contacts that extend through the housing. Each leadframe assembly may be adapted to maintain the width of the gap between contacts that form a pair along respective portions of the contacts that extend through the housing.

BRIEF DESCRIPTION OF THE DRAWINGS

The invention is further described in the detailed description that follows, by reference to the noted drawings by way of non-limiting illustrative embodiments of the invention, in which like reference numerals represent similar parts throughout the drawings, and wherein.

DETAILED DESCRIPTION OF ILLUSTRATIVE EMBODIMENTS

The subject matter of the present invention is described with specificity to meet statutory requirements. However, the description itself is not intended to limit the scope of this patent. Rather, the inventors have contemplated that the claimed subject matter might also be embodied in other ways, to include different steps or elements similar to the ones described in this document, in conjunction with other present or future technologies. Moreover, certain terminology may be used in the following description for convenience only and should not be considered as limiting the invention in any way. For example, the terms "top," "bottom," "left," "right," "upper," and "lower" designate directions in the figures to which reference is made. Likewise, the terms "inwardly" and "outwardly" designate directions toward and away from, respectively, the geometric center of the referenced object. The terminology includes the words above specifically mentioned, derivatives thereof, and words of similar import.

Figure 1A:
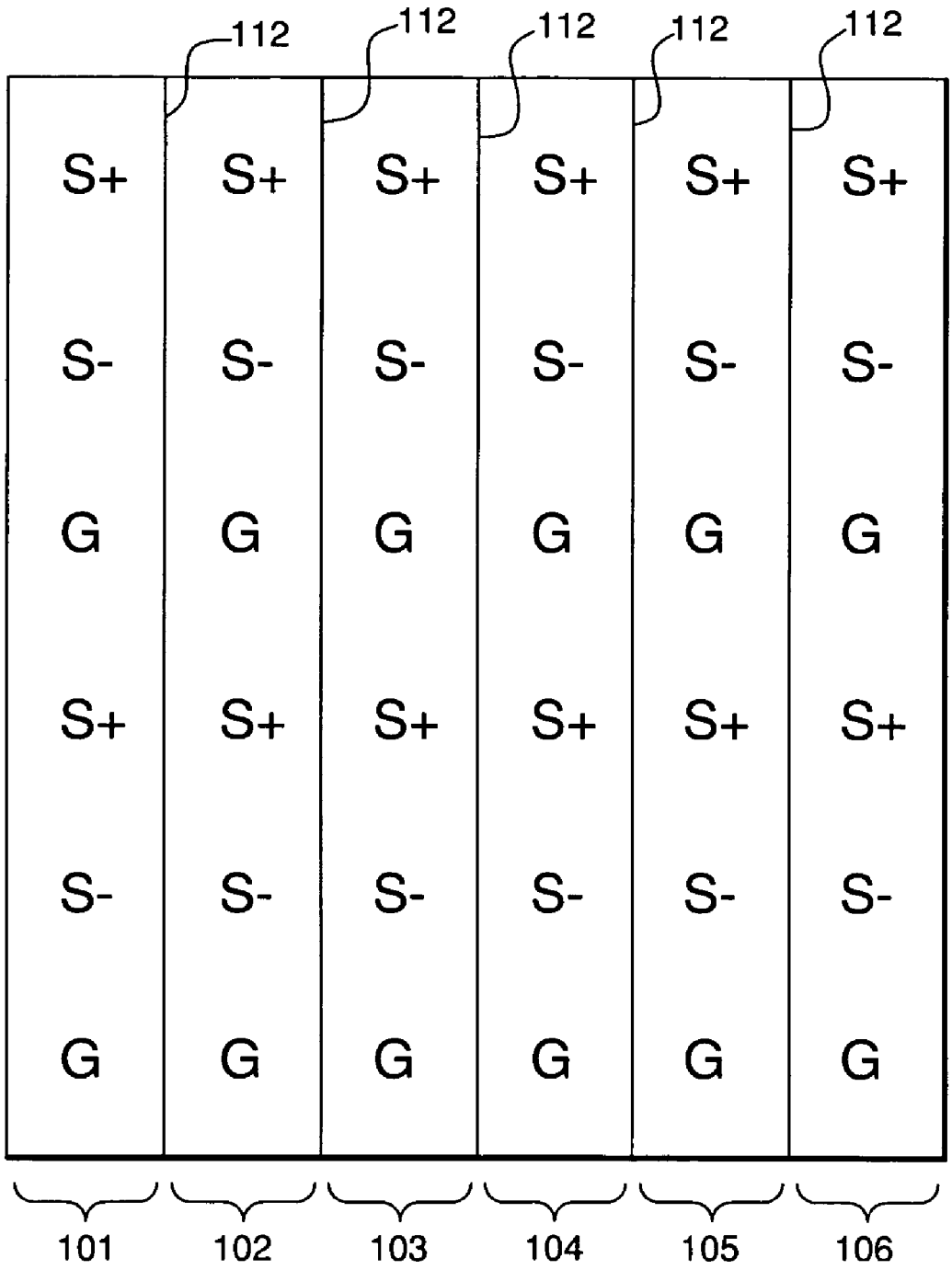
FIG. 1A (PRIOR ART)
FIGS. 1A and 1B depict exemplary prior art contact arrangements for electrical connectors that use shields to block cross talk.
Figure 1B:
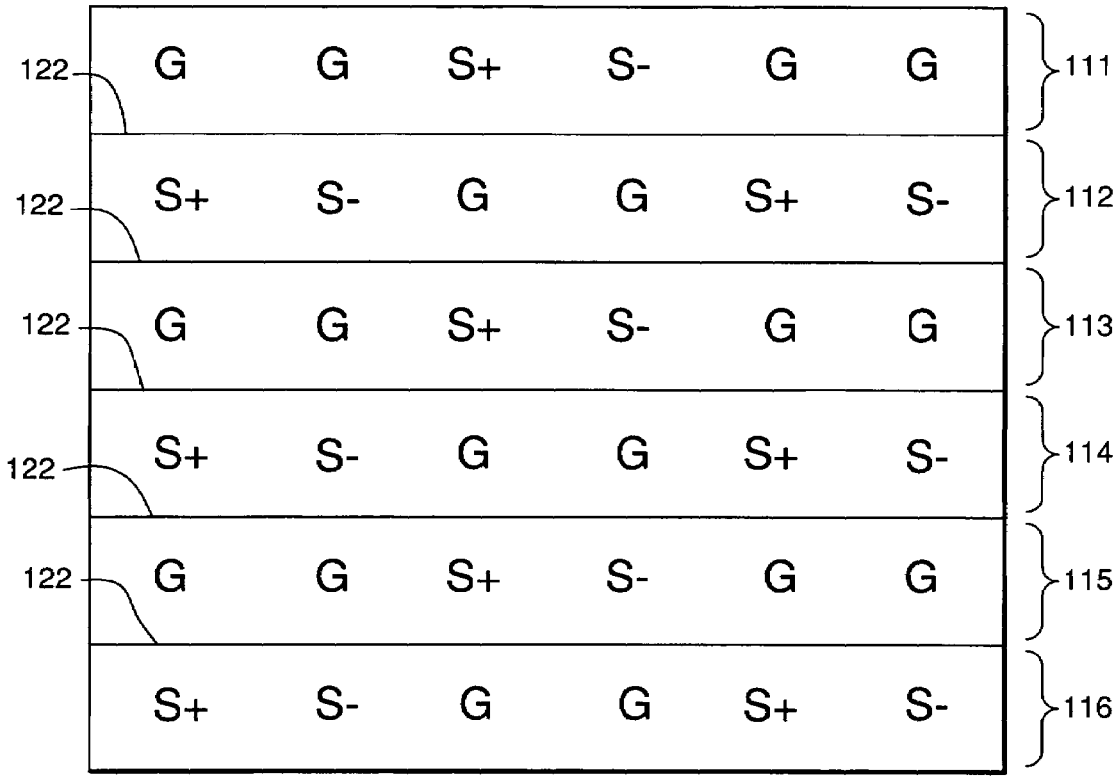
FIG. 1B (PRIOR ART)
Figure 2A:
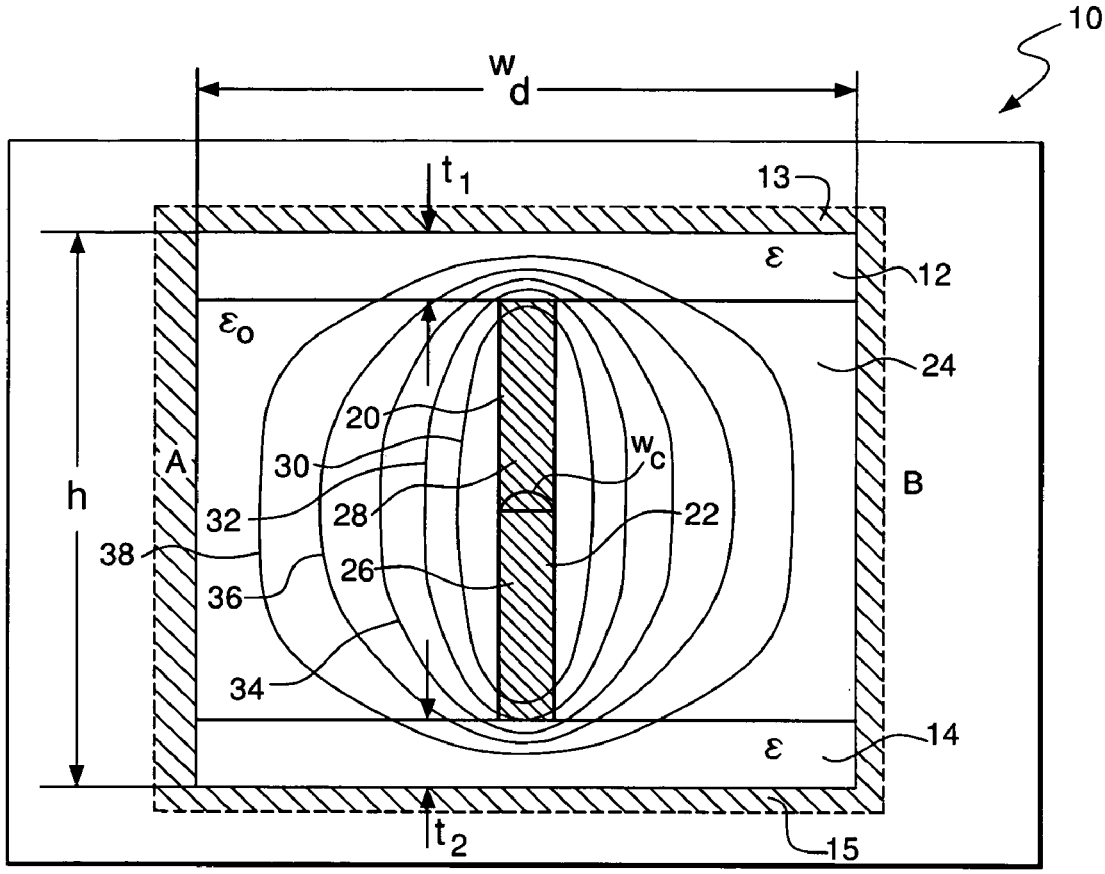
FIG. 2A (PRIOR ART)
FIG. 2A is a schematic illustration of a prior art electrical connector in which conductive and dielectric elements are arranged in a generally "I" shaped geometry.

FIG. 2A is a schematic illustration of an electrical connector in which conductive and dielectric elements are arranged in a generally "I" shaped geometry. Such connectors are embodied in the assignee's "I-BEAM" technology, and are described and claimed in U.S. Pat. No. 5,741,144, entitled "Low Cross And Impedance Controlled Electric Connector," the disclosure of which is hereby incorporated herein by reference in its entirety. Low cross talk and controlled impedance have been found to result from the use of this geometry.

The originally contemplated I-shaped transmission line geometry is shown in FIG. 2A. As shown, the conductive element can be perpendicularly interposed between two parallel dielectric and ground plane elements. The description of this transmission line geometry as I-shaped comes from the vertical arrangement of the signal contact shown generally at numeral 10 between the two horizontal dielectric layers 12 and 14 having a dielectric constant $\in$ and ground planes 13 and 15 symmetrically placed at the top and bottom edges of the conductor. The sides 20 and 22 of the conductor are open to the air 24 having an air dielectric constant $\in_0$. In a connector application, the conductor could include two sections, 26 and 28, that abut end-to-end or face-to-face. The thickness, $t_1$ and $t_2$ of the dielectric layers 12 and 14, to first order, controls the characteristic impedance of the transmission line and the ratio of the overall height h to dielectric width $w_d$ controls the electric and magnetic field penetration to an adjacent contact. Original experimentation led to the conclusion that the ratio $h/w_d$ needed to minimize interference beyond A and B would be approximately unity (as illustrated in FIG. 2A).

The lines 30, 32, 34, 36 and 38 in FIG. 2A are equipotentials of voltage in the air-dielectric space. Taking an equipotential line close to one of the ground planes and following it out towards the boundaries A and B, it will be seen that both boundary A or boundary B are very close to the ground potential. This means that virtual ground surfaces exist at each of boundary A and boundary B. Therefore, if two or more I-shaped modules are placed side-by-side, a virtual ground surface exists between the modules and there will be little to no intermingling of the modules' fields. In general, the conductor width $w_c$. and dielectric thicknesses $t_1$, $t_2$ should be small compared to the dielectric width $W_d$ or module pitch (i.e., distance between adjacent modules).

Given the mechanical constraints on a practical connector design, it was found in actuality that the proportioning of the signal contact (blade/beam contact) width and dielectric thicknesses could deviate somewhat from the preferred ratios and some minimal interference might exist between adjacent signal contacts. However, designs using the above described I-shaped geometry tend to have lower cross talk than other conventional designs.

Figure 2B:
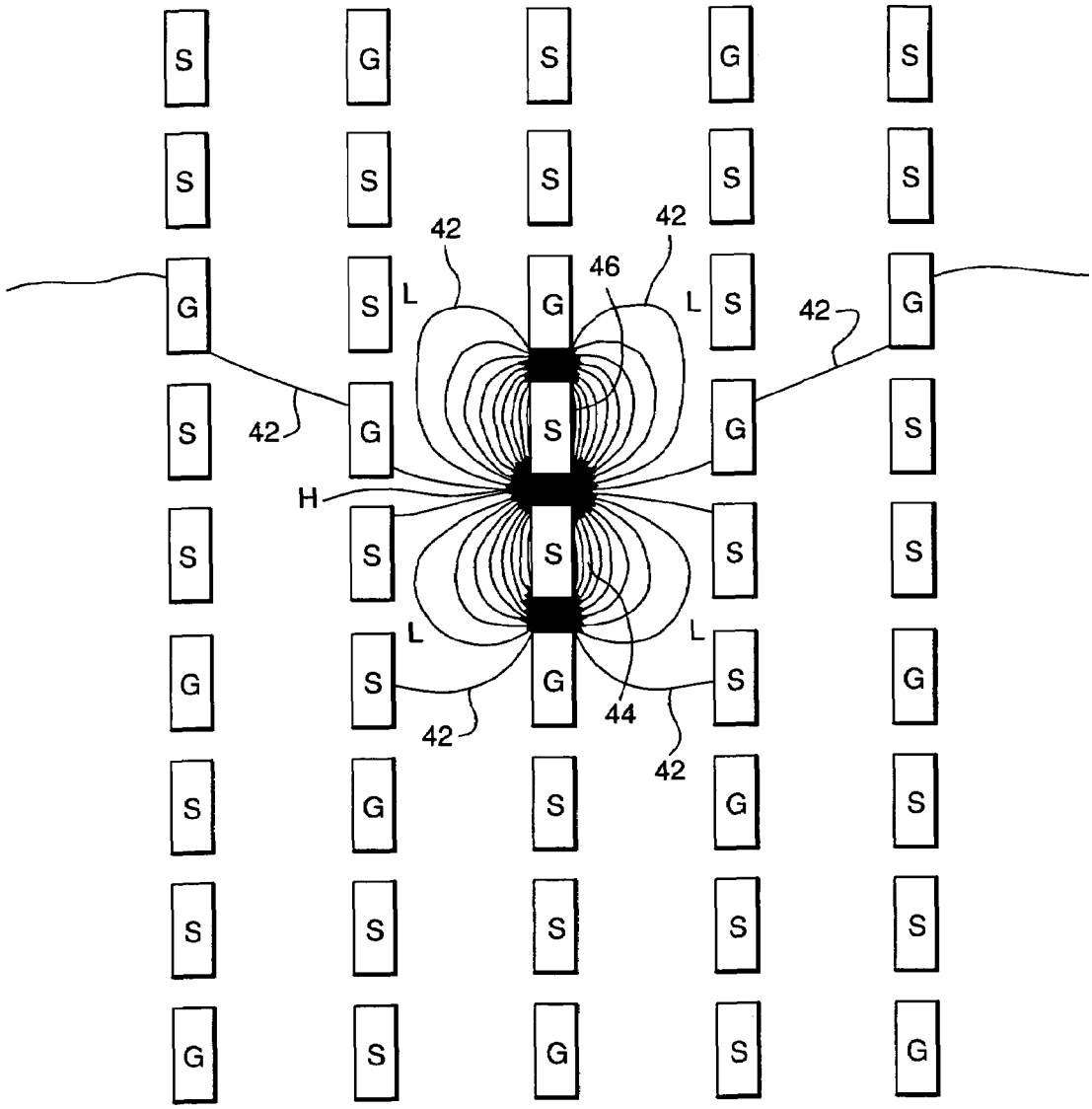
FIG. 2B depicts equipotential regions within an arrangement of signal and ground contacts.

In accordance with an embodiment of the invention, the basic principles described above were further analyzed and expanded upon and can be employed to determine how to even further limit cross talk between adjacent signal contacts. Such analysis first addresses the need to remove shields from between the contacts by determining an appropriate arrangement and geometry of the signal and ground contacts. FIG. 2B includes a contour plot of voltage in the neighborhood of an active column-based differential signal pair S+, S− in a contact arrangement of signal contacts S and ground contacts G according to the invention. As shown, contour lines 42 are closest to zero volts, contour lines 44 are closest to −1 volt, and contour lines 46 are closest to +1 volt. It has been observed that, although the voltage does not necessarily go to zero at the "quiet" differential signal pairs that are nearest to the active pair, the interference with the quiet pairs is near zero. That is, the voltage impinging on the positive-going quiet differential pair signal contact is about the same as the voltage impinging on the negative-going quiet differential pair signal contact. Consequently, the noise on the quiet pair, which is the difference in voltage between the positive- and negative-going signals, is close to zero.

Thus, as shown in FIG. 2B, the signal contacts S and ground contacts G can be scaled and positioned relative to one another such that a differential signal in a first differential signal pair produces a high field H in the gap between the contacts that form the signal pair and a low (i.e., close to ground potential) field L (close to ground potential) near an adjacent signal pair. Consequently, cross talk between adjacent signal contacts can be limited to acceptable levels for the particular application. In such connectors, the level of cross talk between adjacent signal contacts can be limited to the point that the need for (and cost of) shields between adjacent contacts is unnecessary, even in high speed, high signal integrity applications.

Through further analysis of the above-described I-shaped model, it has been found that the unity ratio of height to width is not as critical as it first seemed. It has also been found that a number of factors can affect the level of cross talk between adjacent signal contacts. For example, it has been found that one such factor is the distance between the broadside-coupled contacts that form a differential signal pair. In an embodiment, therefore, the careful control of the distance between the broadside-coupled contacts may be used to maintain an appropriate differential impedance $Z_0$ so as to reduce cross talk between signal pairs. Such a configuration is particularly suitable for mezzanine-style connectors, and such a connector will be discussed below in connection with FIGS. 5A-8. However, it will be appreciated that the invention is not limited to mezzanine connectors, and may be employed in a variety of connector applications.

Figure 3:
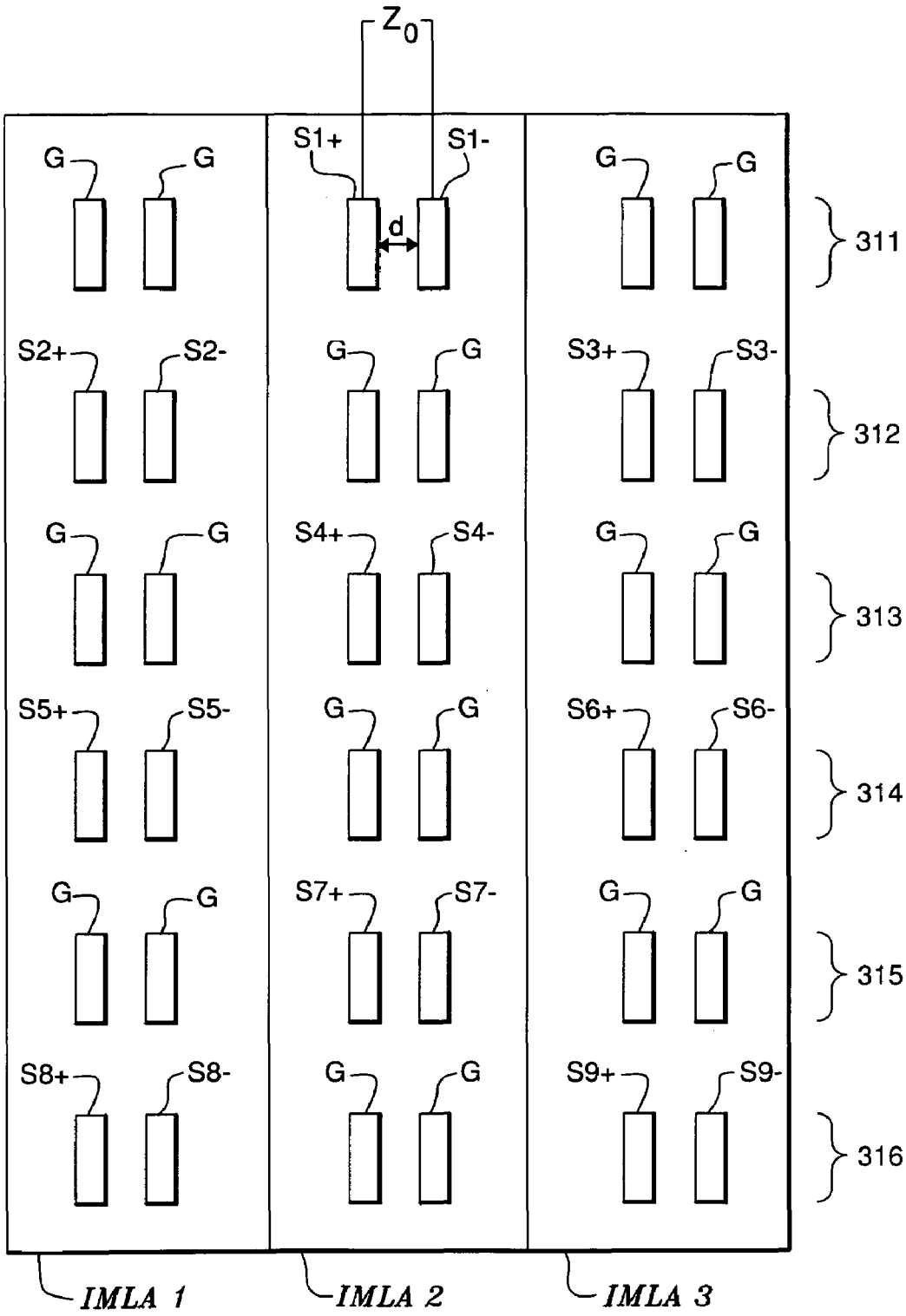
FIG. 3 depicts a conductor arrangement in which signal pairs are arranged in rows.

FIG. 3 depicts a conductor arrangement in which signal pairs and ground contacts are arranged in rows. The conductor arrangement of FIG. 3 is shown for purposes of comparison, as the arrangement does not depict the "split IMLA" configuration to be discussed below in connection with FIGS. 4-8B. As shown in FIG. 3, each row 311-316 comprises a repeating sequence of two ground contacts and a differential signal pair. Row 311, for example, comprises, in order from left to right, two ground contacts G, a differential signal pair S1+, S1−, and two ground contacts G. Row 312, for example, comprises, in order from left to right, a differential signal pair S2+, S2−, two ground contacts G, and a differential signal pair S3+, S3−. In the embodiment shown in FIG. 3, it can be seen that the columns of contacts can be arranged as insert molded leadframe assemblies ("IMLAs"), such as IMLAs 1-3. The ground contacts may serve to block cross talk between adjacent signal pairs. However, the ground contacts take up valuable space within the connector. As can be seen, the embodiment shown in FIG. 3 is limited to only nine differential signal pairs for an arrangement of 36 contacts because of the presence of the ground contacts.

Regardless of whether the signal pairs are arranged into rows (broadside-coupled) or columns (edge coupled), each differential signal pair has a differential impedance $Z_0$ between the positive and negative conductors of the differential signal pair. Differential impedance is defined as the impedance existing between two signal contacts of the same differential signal pair, at a particular point along the length of the differential signal pair. As is well known, it is desirable to control the differential impedance $Z_0$. to match the impedance of the electrical device(s) to which the connector is connected. Matching the differential impedance $Z_0$ to the impedance of an electrical device minimizes signal reflection and/or system resonance that can limit overall system bandwidth. Furthermore, it is desirable to control the differential impedance $Z_0$ such that it is substantially constant along the length of the differential signal pair, i.e., such that each differential signal pair has a substantially consistent differential impedance profile. The distance d of an air dielectric between the contacts that form a differential signal pair (such as signal contacts S1+ and S1−, for example) can determine the impedance $Z_0$ between each of the contacts.

As noted above, the differential impedance profile can be controlled by the positioning of the signal and ground contacts. Specifically, differential impedance $Z_0$ can be determined by the proximity of an edge of a signal contact to an adjacent ground and by the gap distance d between edges of signal contacts within a differential signal pair. However, and significantly, if a proper geometry of broadside-coupled differential signal pairs is attained by precisely maintaining the distance between the contacts of the signal pair, the cross talk between multiple differential signal pairs can be reduced to the point that ground contacts are unnecessary. In other words, the signal quality that results from precisely maintaining an appropriate distance between broadside-coupled signal pairs is high enough to render any additional improvement in signal quality that may be gained by the presence of ground contacts either irrelevant for the connector's intended application, or not worth the attendant increase in size and/or weight of the connector.

To maintain acceptable differential impedance $Z_0$. control for high bandwidth systems, it is desirable to control the gap distance d between contacts to within a few thousandths of an inch. Gap variations beyond a few thousandths of an inch may cause unacceptable variation in the impedance profile; however, the acceptable variation is dependent on the speed desired, the error rate acceptable, and other design factors, any weighing or consideration of which is equally consistent with an embodiment of the present invention. When both contacts of a given signal pair are formed within the same IMLA, the distance d is difficult to maintain at the levels of precision desired for establishing and maintaining a near constant differential impedance $Z_0$.

According to an embodiment of the invention, a "split" IMLA configuration is provided where each IMLA has two lengthwise housing halves, each half corresponding to a respective contact column. It will be appreciated in the discussion that follows that the placing of one contact of a signal pair in a recess of each portion of the lead frame assembly (e.g., the header or receptacle portions of the IMLA) enables greater precision in maintaining the gap distance d between contacts. As a result, the differential impedance $Z_0$. can be controlled so as to minimize cross-talk between signal pairs to such an extent as necessary to enable removal of the ground contacts.

Figure 4:
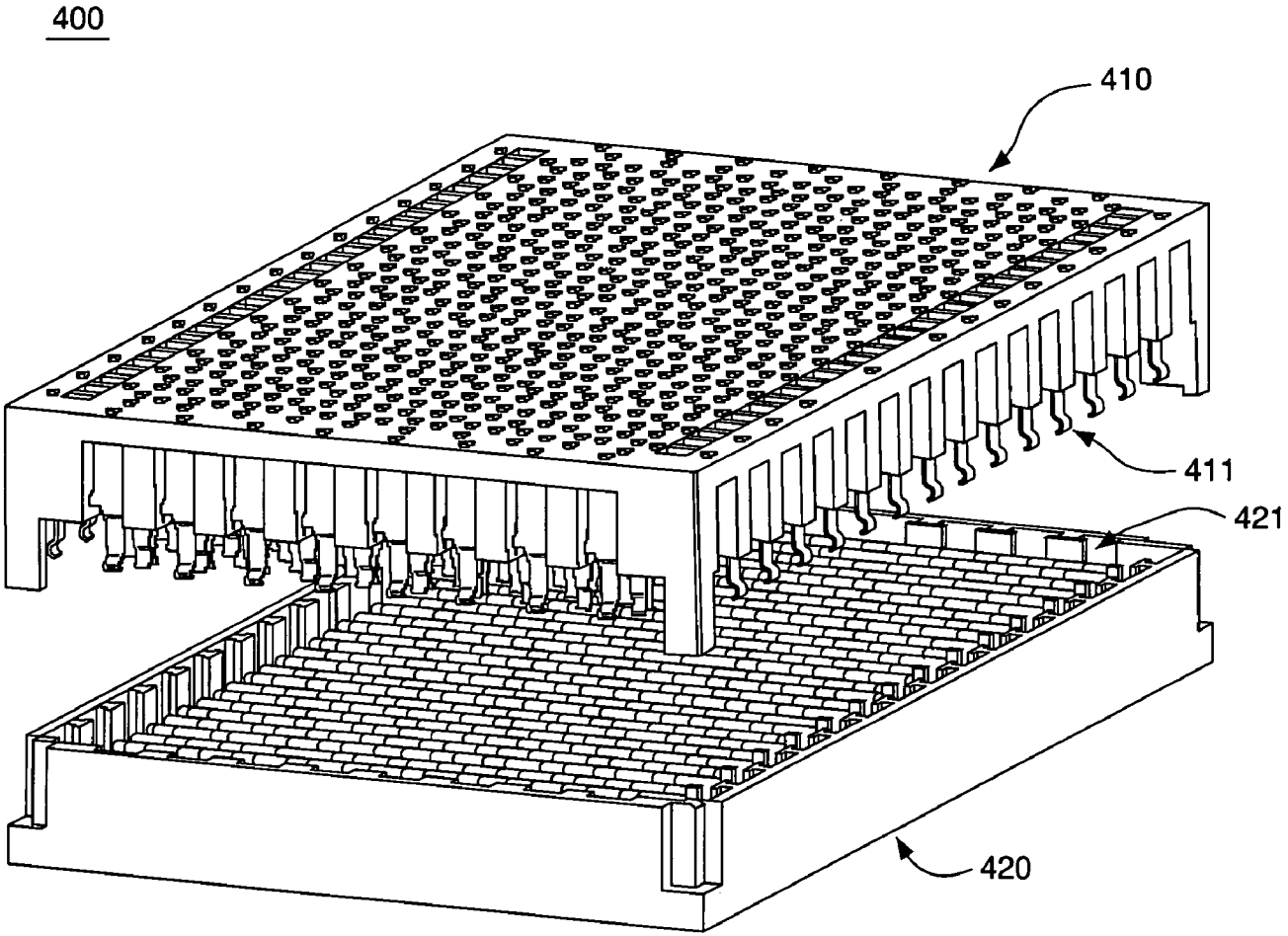
FIG. 4 depicts a mezzanine-style connector assembly in accordance with an example embodiment of the invention.

Referring now to FIG. 4, a mezzanine-style connector assembly in accordance with one embodiment of the invention is depicted. It will be appreciated that a mezzanine connector is a high-density stacking connector used for parallel connection of printed circuit boards and the like. Such a mezzanine connector can be used to relocate, for example, high pin count devices onto mezzanine or module cards to simplify board routing without compromising system performance. The mezzanine connector assembly 400 illustrated in FIG. 4 comprises a receptacle 410 having receptacle grounds 411 arranged around the outside of the receptacle 410, and a header 420 having header grounds 421 arranged around the outside of the header 420. The header 420 also contains header IMLAs (not individually labeled in FIG. 4 for clarity) and the receptacle 410 contains receptacle IMLAs (also not individually labeled in FIG. 4 for clarity).

It will be appreciated that the receptacle 410 and header 420 can be mated to operatively connect the receptacle and header IMLAs. It will also be appreciated that, according to one embodiment of the invention, the grounds shown in FIG. 4, may be the only grounds in the connector.

As noted above, maintaining careful control of the distance between broadside-coupled contacts that form signal pairs can reduce cross talk between signal pairs. In an embodiment of the invention, such distance control is maintained by using each "split" half of an IMLA (e.g., receptacle and header IMLAs) to maintain precise spacing between contacts of a differential signal pair throughout a connector.

Figure 5B:
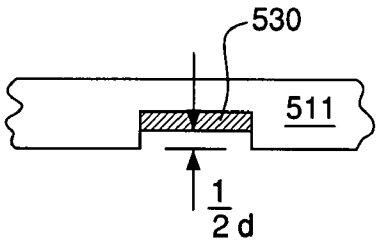
FIGS. 5A-C depict a receptacle IMLA pair in accordance with an embodiment of the present invention.
Figure 5A:
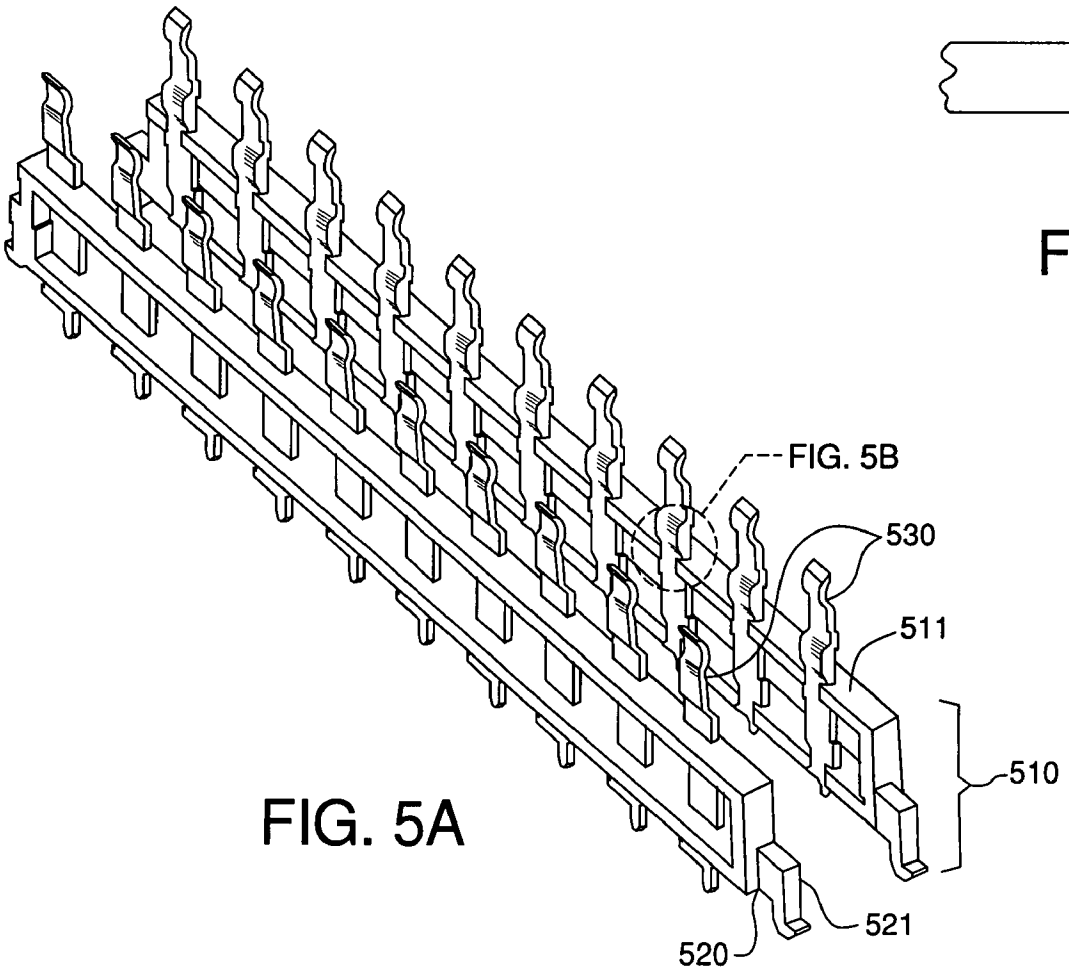
Figure 5C:
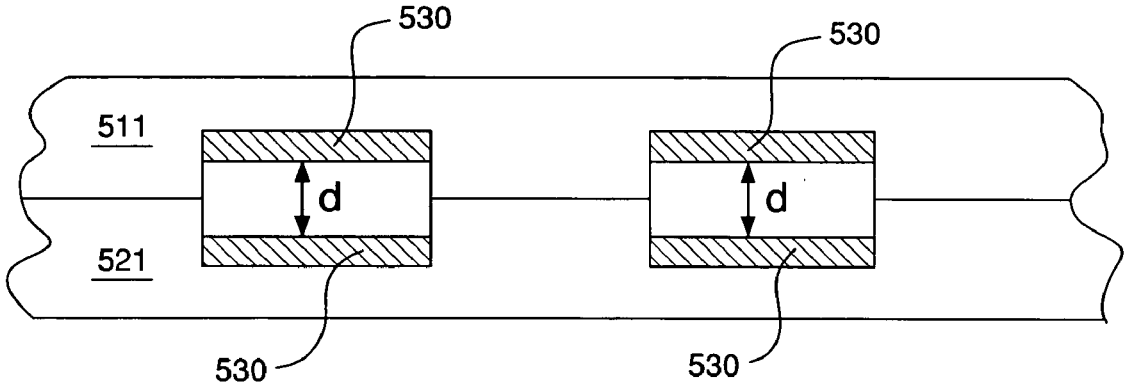

FIGS. 5A-C depict a receptacle IMLA pair in accordance with an embodiment of the invention. Referring first to FIG. 5A, a first receptacle IMLA 510 comprises an overmolded housing 511 and a series of receptacle contacts 530, and a second receptacle IMLA 520 comprises an overmolded housing 521 and a series of receptacle contacts 530. As can be seen in FIG. 5A, the receptacle contacts 530 are recessed into the housings of receptacle IMLAs 510 and B 520. It will be appreciated that fabrication techniques permit the recesses in each portion of the IMLA 510, 520 to be sized very precisely. As a result, the gap distance d between each signal contact can be maintained throughout a connector fabricated in accordance with an embodiment of the present invention.

Turning now to FIG. 5B, a detailed view of one such recessed receptacle contact 530 in receptacle IMLA 510 is shown. As can be seen in FIG. 5B, the housing 511 of receptacle IMLA 510 is recessed so the contact 530 sits within the housing such that the distance from the outside broad side of the contact 530 to the outside edge of the housing 511 is ½d. The total distance d extends from the outside broad side of the contact 530 to the outside broad side of a contact 530 of receptacle IMLA 520 (not shown in FIG. 5B for clarity), with which IMLA 510 will be operatively coupled. It will readily be appreciated that the distance provided by either IMLA 510 or IMLA 520 can be any fraction of d, so long as the total distance d is formed when IMLA 510 and IMLA 520 are operatively coupled.

FIG. 5C shows a detailed view of receptacle IMLA 510 operatively coupled to receptacle IMLA 520. It will be appreciated that in an embodiment any manner of operatively coupling receptacle IMLAs 510 and B 520 may be used. Thus, in an interference fit, fasteners and the like may be used alone or in any combination to affect such coupling.

In FIG. 5C, it can be seen that the housing 511 of receptacle IMLA 510 abuts the housing 521 of receptacle IMLA 520. Contacts 530 sit within respective recesses in the housings 511 and 521. It will be appreciated that operatively coupling the overmolded housings 511 and 521 as shown in FIG. 5C places a broad side of each contact 530 (i.e., the broad side that is facing the opposing contact 530) at a distance d from the opposing contact 530. In an embodiment, the distance d is able to be maintained at a high level of precision because of the low tolerances possible with overmolded housing fabrication, as well as contact fabrication. Because the distance d only depends on these two, highly-precise components, the distance d can be maintained within the very low acceptable variations that are needed to maintain an appropriate differential impedance $Z_0$.

It will be appreciated that, in an embodiment of the invention, the distance d may be bridged by an air dielectric as discussed above. Thus, the weight of the resulting connector, of which the receptacle IMLAs 510 and 520 are a part, may be minimized. It will also be appreciated that the ability to closely control the size of the recess within each overmolded housing 511, 521 enables the impedance $Z_0$ between the contacts that form signal pairs (and, consequently, cross-talk between signal pairs) to be closely controlled.

Because the above-mentioned differential impedance $Z_0$ (and therefore cross talk between signal pairs) is controlled by maintaining a precise distance d, it will be appreciated that a header IMLA that is to be coupled to a receptacle IMLA should also carefully maintain a precise distance d between signal pairs. Therefore, and turning now to FIGS. 6A-C, a header IMLA pair in accordance with an embodiment of the present invention is depicted. Referring first to FIG. 6A, header IMLA 610 comprises an overmolded housing 611 and a series of header contacts 630, and header IMLA 620 comprises an overmolded housing 621 and a series of header contacts 630. As can be seen in FIG. 6A, the header contacts 630 are recessed into the housings of header IMLAs 610 and 620.

Figure 6B:
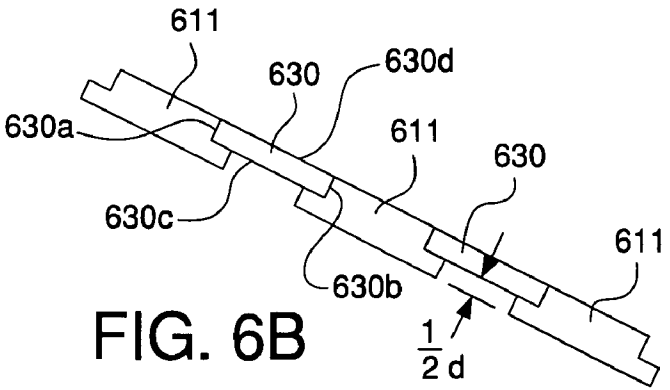
FIGS. 6A-C depict a header IMLA pair in accordance with an embodiment of the present invention.
Figure 6A:
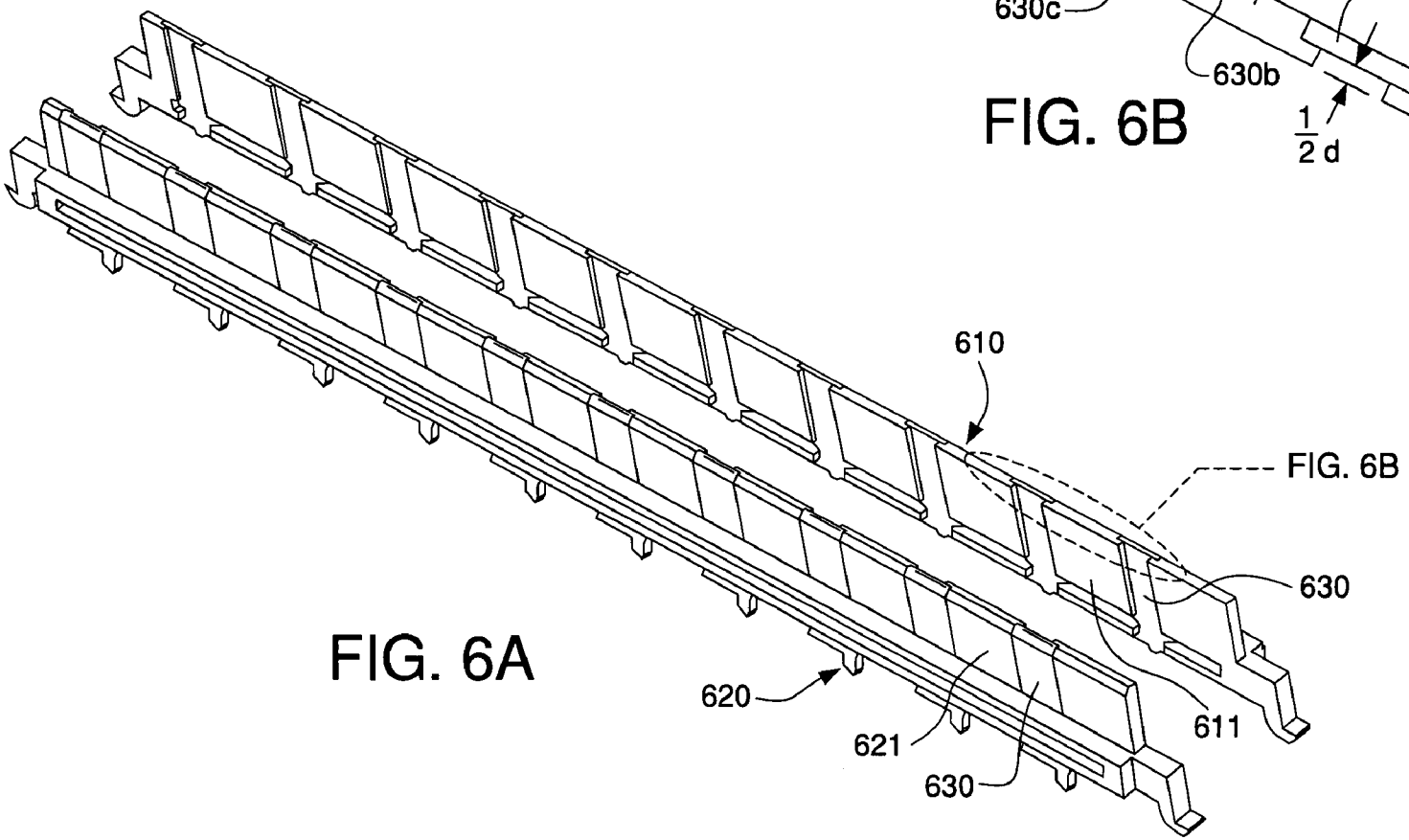

Turning now to FIG. 6B, a detailed view of one such recessed header contact 630 in header IMLA 610 is shown. As can be seen in FIG. 6B, the housing 611 of IMLA 610 is recessed so the contact 630 sits within the housing such that the distance from the inside broad side of the contact 630 to the inside edge of the housing 611 (i.e., the side of the housing 611 that will abut the housing 621 of header IMLA 620—not shown in FIG. 6B for clarity) is ½ the total distance d from the inside broad side of the contact 630 to the inside broad side of a contact 630 of IMLA 620. Again, it will readily be appreciated that the distance provided by either IMLA 610 or IMLA 620 can be any fraction of d, so long as the distance d is formed when IMLA 610 and IMLA 620 are operatively coupled.

Figure 6C:
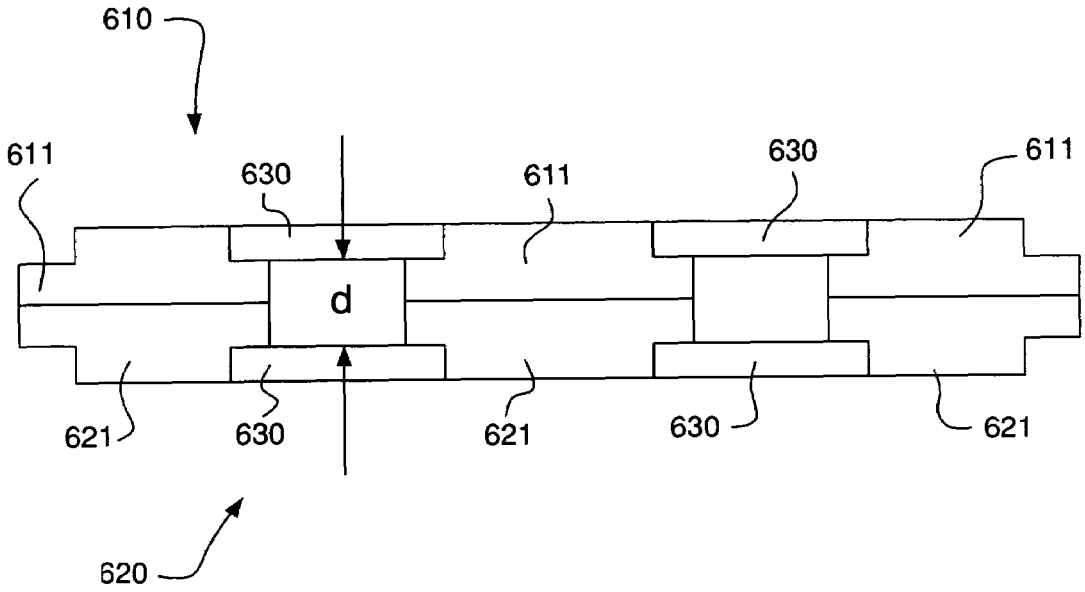

FIG. 6C shows a detailed view of header IMLA 610 operatively coupled to header IMLA 620. It will be appreciated that in an embodiment any manner of operatively coupling header IMLAs 610 and 620 may be used. Thus, an interference fit, fasteners and the like may be used alone or in any combination to affect such coupling, and any such coupling may be accomplished by the same or a different method used to operatively couple the receptacle IMLAs discussed above in connection with FIGS. 5A-C.

In FIG. 6C, it can be seen that the housing 611 of header IMLA 610 abuts the housing 621 of header IMLA 620. Within respective recesses in both housings 611 and 621 are contacts 630. It will be appreciated that operatively coupling the housings 611 and 621 as shown in FIG. 6C places a respective broad side of each contact 630 (i.e., the broad side that is facing the opposing contact 630) at a distance d from the opposing contact 630. Thus, the differential impedance $Z_0$. as discussed above in connection with FIG. 3 may be established because of the distance d maintained between the contacts 630 of header IMLAs 610 and 620. It will also be appreciated that the aforementioned ability to closely control the size of the recess within each housing 611, 621, as well as the contact size, enables differential impedance $Z_0$ and cross-talk to be closely controlled.

Figure 7:
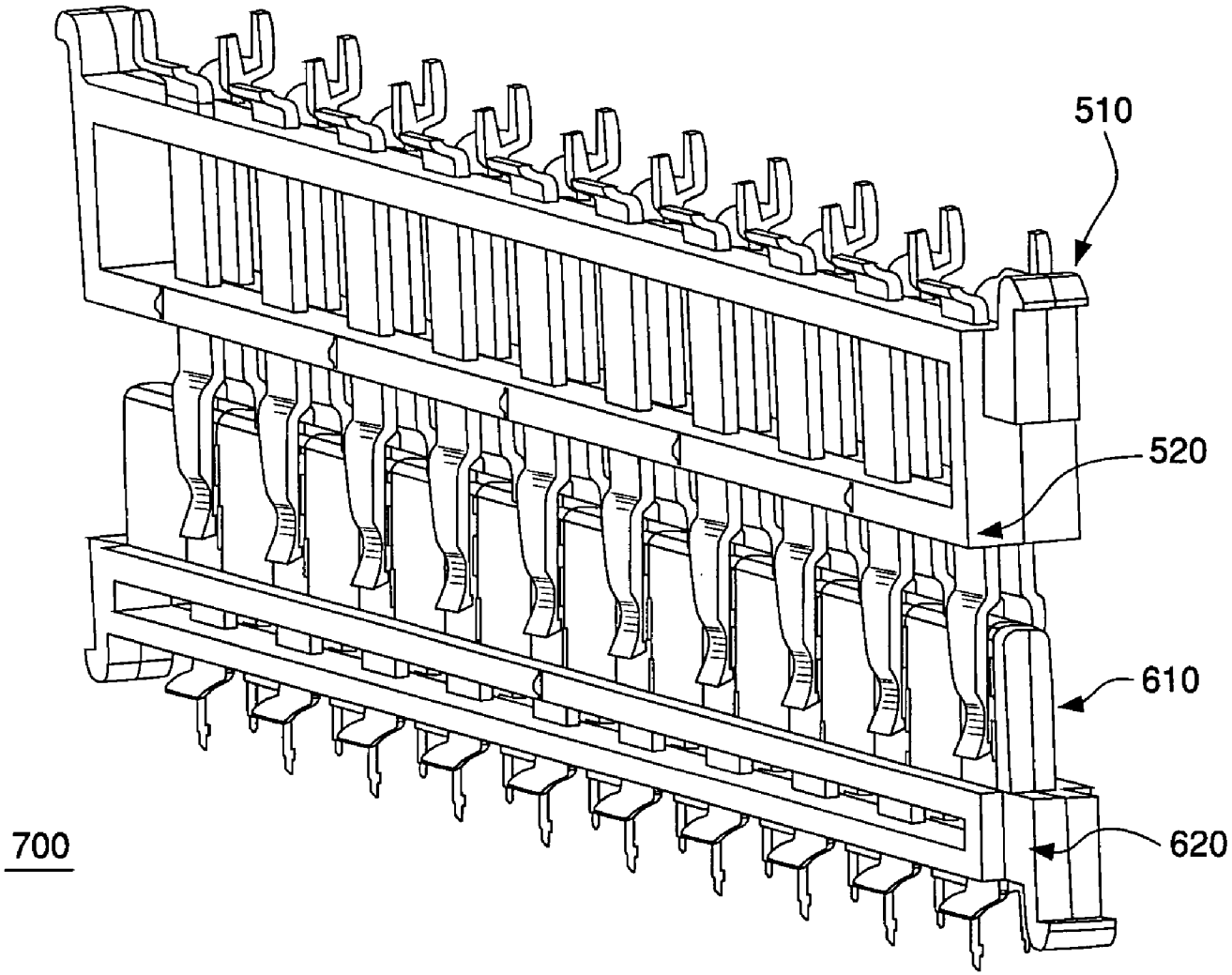
FIG. 7 depicts a header and receptacle IMLA pair in operative communications in accordance with an embodiment of the present invention.

Turning now to FIG. 7, a header and receptacle IMLA pair in operative communications in accordance with an embodiment of the present invention is depicted. In FIG. 7, it can be seen that header IMLAs 610 and B 620 are operatively coupled to form a single and complete header IMLA. Likewise, receptacle IMLAs 510 and B 520 are operatively coupled to form a single and complete receptacle IMLA. While FIG. 7 illustrates an interference fit between the contacts 630 of the receptacle IMLA and the contacts of the header IMLA, it will be appreciated that any method of causing electrical contact, and/or for operatively coupling the header IMLA to the receptacle IMLA, is equally consistent with an embodiment of the present invention.

As can be seen in FIG. 7, the contacts of the receptacle IMLA may be flared to accept the contacts of the header IMLA. As a result, the precise maintenance of the distance d between contacts within both the receptacle IMLA and the header IMLA enables the differential impedance $Z_0$ to be carefully controlled through the connector. This, in turn, minimizes cross talk between signal pairs, even in the absence of ground contacts.

Figure 8A:
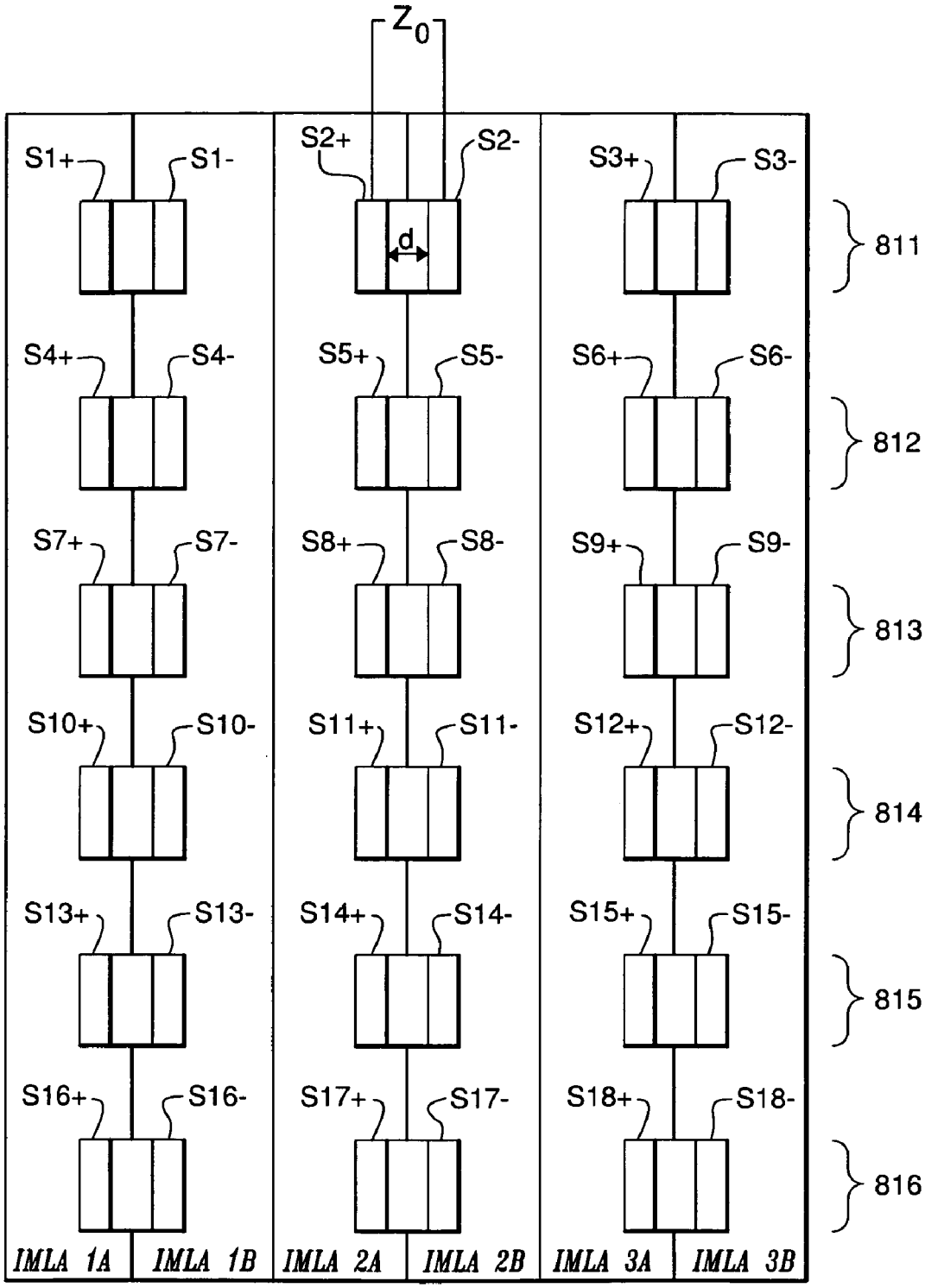
FIGS. 8A-B depict exemplary contact arrangements for an electrical connector in accordance with an embodiment of the present invention.

Turning now to FIG. 8A, a conductor arrangement is depicted in which signal pairs are arranged in rows. As can be seen in FIG. 5A, each row 811-816 comprises a plurality of differential signal pairs. First row 811 comprises, in order from left to right, three differential signal pairs: S1+ and S1−, S2+ and S2−, and S3+ and S3−. Each additional row in the exemplary arrangement of FIG. 8A contains three differential signal pairs. In the embodiment shown in FIG. 8A, and as was the case with FIG. 3, it can be seen that the columns of contacts can be arranged as IMLAs, such as IMLAs 1-3. In addition, each IMLA has two lengthwise halves in a split configuration, A and B, that correspond to each column. Unlike the arrangement discussed above in connection with FIG. 3, no ground contacts are needed because the cross talk between adjacent signal pairs may be minimized by the proper selection of the differential impedance $Z_0$. that is possible by maintaining a precise distance d between signal contacts. Thus, in an embodiment of the invention, and as shown in FIG. 8A, the connector may be devoid of ground contacts.

As can be seen, therefore, the embodiment shown in FIG. 8A provides 18 differential signal pairs for an arrangement of 36 contacts, which is a significant improvement over the nine differential signal pairs in the arrangement depicted above in FIG. 3. Thus, a connector according to the invention may be lighter and smaller for a given number of differential signal pairs, or have a greater concentration of differential signal pairs for a given weight and/or size of the connectors.

Figure 8B:
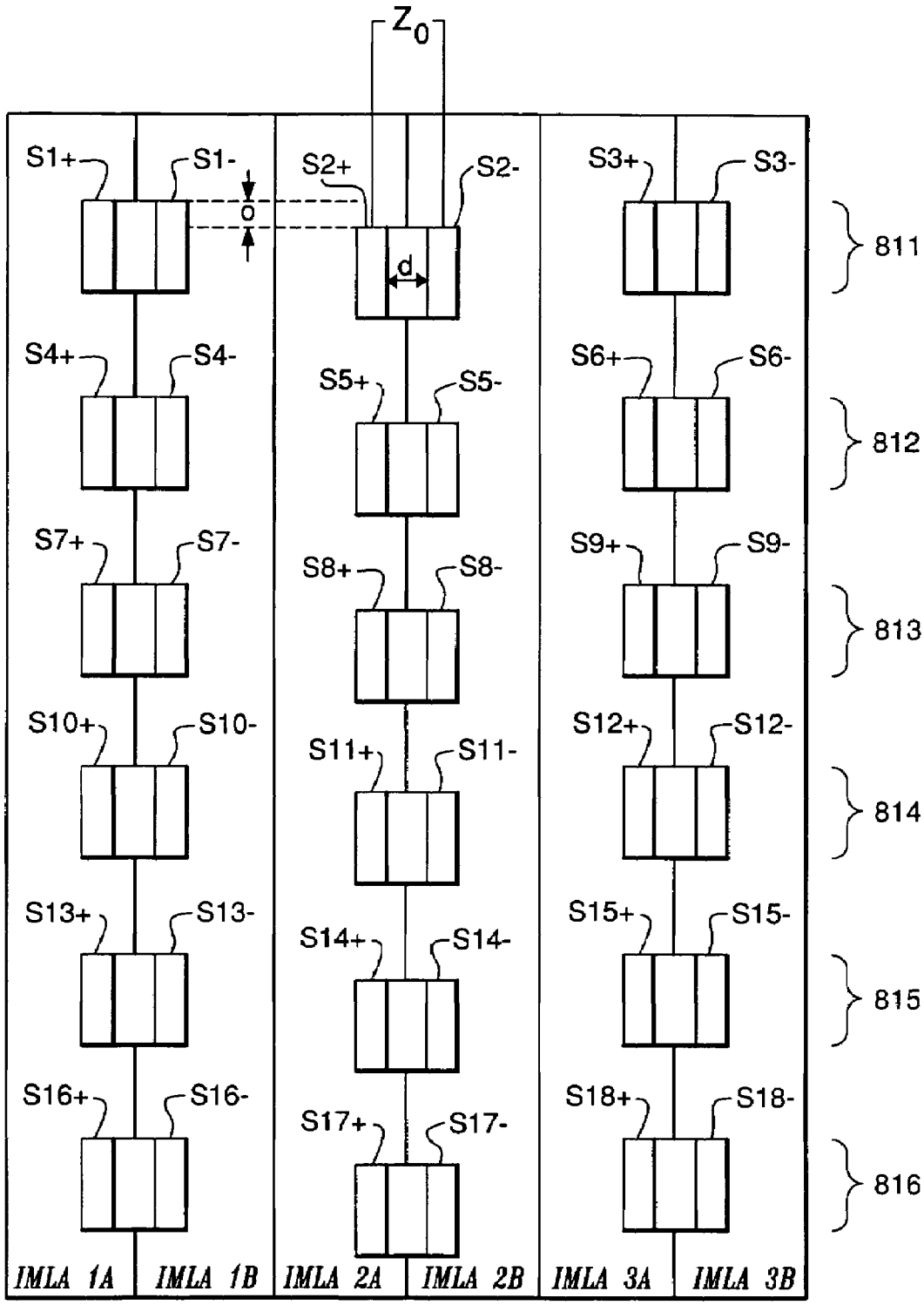

It will be appreciated that an embodiment of the present invention encompasses any number of conductor arrangements. For example, the conductor arrangement depicted in FIG. 8B shows that adjacent columns of broadside-coupled pairs may be offset from each other. The conductor arrangement, like the arrangement of FIG. 8A, above, has 36 contacts in 18 signal pairs that are equally divided between IMLAs 1-3 in rows 811-816. It can be seen that IMLAs 1-3 are in the aforementioned split configuration, where each IMLA has a lengthwise half denoted as A and B. In addition, and as noted above, each contact in a given signal pair is separated by a precisely-maintained distance d, which enables the differential impedance $Z_0$. to be carefully controlled through the connector.

Unlike the connector of FIG. 8A, however, the pairs disposed along IMLA 2 are offset from the pairs disposed along IMLAs 1 and 3 by an offset distance o. For comparison, it can be seen that in FIG. 8A, the IMLAs 1-3 are arranged such that the conductor pairs that comprise each row 811-816 are in alignment. It will be appreciated that the magnitude of the offset distance o in FIG. 8B may be determined by any number and type of considerations, such as for example the intended application of the connector or the like. In addition, it will be appreciated that any or all of the IMLAs present in a given connector may be offset from any other IMLA within the connector by any offset distance o. In such embodiments, the offset distance o between any two IMLAs may be the same as or different from the offset distance o between any other IMLAs within the connector.

It will be further appreciated that the offset distance o and the distance d may be set so as to achieve a desired differential impedance $Z_0$. Therefore, while some embodiments may achieve a desired differential impedance $Z_0$ by precisely maintaining the distance d alone, other embodiments may achieve a desired differential impedance $Z_0$, by maintaining the distance d in combination with setting one or more offset distances o.

Thus, a method and system for split IMLA impedance control has been disclosed. It is to be understood that the foregoing illustrative embodiments have been provided merely for the purpose of explanation and are in no way to be construed as limiting of the invention. Words which have been used herein are words of description and illustration, rather than words of limitation. Further, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

What is claimed:

1. An electrical connector comprising:

a first leadframe housing having a first mating face, a first mounting face, and a first electrical contact extending through the first mating face and the first mounting face; and a second leadframe housing having a second mating face, a second mounting face, and a second electrical contact extending through the second mating face and the second mounting face, wherein (i) a portion of the first electrical contact that extends from the first mating face to the first mounting face has a first face extending the entire length of the portion, (ii) a portion of the second electrical contact that extends from the second mating face to the second mounting face has a second face extending the entire length of the portion, (iii) each of the first and second faces has a respective first edge portion, a second edge portion, a third edge portion opposite the first edge portion, and a fourth edge portion opposite the second edge portion, (iv) each edge portion extends the entire length of a respective side of its respective face, (v) the second leadframe housing is disposed adjacent to the first leadframe housing such that the first face opposes the second face, (vi) the first and third edge portions are covered by a dielectric material, and a section of each of the second and fourth edge portions that is entirely between the dielectric material covering the first and third edge portions is exposed to air, and (vii) an air gap is formed between the electrical contacts entirely between the dielectric material that covers the first and third edge portions.

2. The electrical connector of claim 1, wherein the electrical contacts form a differential signal pair.

3. The electrical connector of claim 1, wherein the electrical contacts are broadside-coupled.

4. The electrical connector of claim 1, wherein the first leadframe housing is made of an electrically insulating material.

5. The electrical connector of claim 1, wherein the first leadframe housing is made of a plastic.

6. The electrical connector of claim 1, wherein the first leadframe housing is insert molded.

7. The electrical connector of claim 1, wherein the first and second leadframe housings are coupled with an interference fit.

8. The electrical connector of claim 1, wherein the first leadframe housing has a first recess, and the first electrical contact sits in the first recess, the second leadframe housing has a second recess, and the second electrical contact sits in the second recess.

9. The electrical connector of claim 8, wherein the first recess has a first depth, the first electrical contact has a first thickness, the second recess has a second depth, and the second electrical contact has a second thickness, and wherein the first and second depths and first and second thicknesses together define the gap width.

10. The electrical connector of claim 1, wherein the first leadframe housing has a recess, and the first electrical contact sits in the recess.

11. The electrical connector of claim 10, wherein the gap has a gap width, and the recess has a depth that at least partially defines the gap width.

12. The electrical connector of claim 10, wherein the first leadframe housing comprises a face that at least partially defines the recess, and the first electrical contact abuts the face.

13. The electrical connector of claim 10, wherein the first leadframe housing comprises a plurality of faces that collectively define the recess, and the first electrical contact abuts each of the faces.

14. The electrical connector of claim 10, wherein the second leadframe housing has a recess, and the second electrical contact sits in the recess of the second leadframe housing.

15. The electrical connector of claim 14, wherein the gap has a gap width, and the recesses have respective depths that at least partially define the gap width.

16. The electrical connector of claim 15, wherein each of the electrical contacts has a respective thickness that at least partially defines the gap width.

17. An electrical connector comprising:

a first lead frame assembly comprising a first leadframe housing, a first signal contact, and a second signal contact adjacent to the first signal contact; and a second lead frame assembly comprising a second leadframe housing, a third signal contact, and a fourth signal contact adjacent to the third signal contact, the first and third signal contacts forming a first differential signal pair and the second and fourth signal contacts forming a second differential signal pair, wherein a first air gap is formed between the first and third signal contacts entirely along portions of the signal contacts that extend through the respective leadframe housings, and a second air gap is formed between the second and fourth signal contacts entirely along portions of the signal contacts that extend through the respective leadframe housings wherein the first air gap has a gap width that provides for a constant impedance along the respective portions of the first and third contacts that extend through the respective leadframe housings.

18. The electrical connector of claim 17, wherein the air gaps have respective gap widths that limit cross-talk between the differential signal pairs.

19. The electrical connector of claim 17, wherein the connector is a mezzanine-style electrical connector.

20. The electrical connector of claim 17, wherein the differential signal pairs are broadside-coupled.

21. The electrical connector of claim 17, wherein the connector is devoid of shields between adjacent differential signal pairs.

22. The electrical connector of claim 17, wherein the first air gap has a gap width that limits interference from the first differential signal pair at the second differential signal pair.

23. The electrical connector of claim 22, wherein the second air gap has a second gap width that limits interference from the second differential signal pair at the first differential signal pair.

24. The electrical connector of claim 23, wherein the first leadframe housing has a first and second recess, and the second leadframe housing has a third and fourth recess, and wherein the first, second, third and fourth signal contacts sit in the first, second, third, and fourth recesses, respectively.

25. The electrical connector of claim 24, wherein the first, second, third, and fourth recesses have first, second, third and fourth depths, respectively, and wherein the first, second, third, and fourth signal contacts have first, second, third, and fourth thicknesses, respectively.

26. The electrical connector of claim 25, wherein the first depth and thickness and the third depth and thickness together define the first gap width.

27. The electrical connector of claim 25, wherein the second depth and thickness and the fourth depth and thickness together define the second gap width.

28. An electrical connector comprising:

a first leadframe housing having a portion of a first electrical contact extending therethrough; and a second leadframe housing having a portion of a second electrical contact extending therethrough, wherein an air gap is formed between the electrical contacts entirely along the portions of the electrical contacts that extend through the leadframe housings, the gap having a gap width that provides for a constant impedance along the respective portions of the contacts that extend through the leadframe housings.

29. The electrical connector of claim 28, wherein the first leadframe housing has a first recess, and the first electrical contact sits in the first recess.

30. The electrical connector of claim 29, wherein the second leadframe housing has a second recess, and the second electrical contact sits in the second recess.

31. The electrical connector of claim 30, wherein the first and second recesses have a first and second depths, respectively, and the first and second electrical contacts have a first and second thicknesses, respectively, and the first and second depths and the first and second thicknesses together define the gap width.

32. An electrical connector comprising:

a connector housing;

a first leadframe housing having a portion of a first electrical contact extending therethrough, the first leadframe housing being disposed in the connector housing; and a second leadframe housing having a portion of a second electrical contact extending therethrough, the second leadframe housing being disposed in the connector housing, wherein the second leadframe housing is disposed adjacent to the first leadframe housing such that an air gap is formed between the respective portions of the electrical contacts that extend through the leadframe housings, wherein the gap has a gap width that provides for a constant impedance along the respective portions of the contacts that extend through the leadframe housings, and wherein the connector housing is devoid of an electrical shield.

33. The electrical connector of claim 32, wherein the electrical contacts form a differential signal pair.

34. The electrical connector of claim 32, wherein the electrical contacts are broadside-coupled.

35. The electrical connector of claim 32, wherein the first leadframe housing is made of an electrically insulating material.

36. The electrical connector of claim 32, wherein the first leadframe housing is made of a plastic.

37. The electrical connector of claim 32, wherein the first leadframe housing is insert molded.

38. The electrical connector of claim 32, wherein the first and second leadframe housings are coupled with an interference fit.

39. The electrical connector of claim 32, wherein the first leadframe housing has a first recess, and the first electrical contact sits in the first recess, the second leadframe housing has a second recess, and the second electrical contact sits in the second recess.

40. The electrical connector of claim 39, wherein the first recess has a first depth, the first electrical contact has a first thickness, the second recess has a second depth, and the second electrical contact has a second thickness, and wherein the first and second depths and first and second thicknesses together define the gap width.

41. The electrical connector of claim 32, wherein the first leadframe housing has a recess, and the first electrical contact sits in the recess.

42. The electrical connector of claim 41, wherein the gap has a gap width, and the recess has a depth that at least partially defines the gap width.

43. The electrical connector of claim 41, wherein the first leadframe housing comprises a face that at least partially defines the recess, and the first electrical contact abuts the face.

44. The electrical connector of claim 41, wherein the first leadframe housing comprises a plurality of faces that collectively define the recess, and the first electrical contact abuts each of the faces.

45. The electrical connector of claim 41, wherein the second leadframe housing has a recess, and the second electrical contact sits in the recess of the second leadframe housing.

46. The electrical connector of claim 45, wherein the gap has a gap width, and the recesses have respective depths that at least partially define the gap width.

47. The electrical connector of claim 46, wherein each of the electrical contacts has a respective thickness that at least partially defines the gap width.

* * * * *